US006900711B2

(12) United States Patent
Vice

(10) Patent No.: US 6,900,711 B2
(45) Date of Patent: May 31, 2005

(54) SWITCHING SYSTEM

(75) Inventor: Michael Wendell Vice, El Granada, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/261,711

(22) Filed: Sep. 30, 2002

(65) Prior Publication Data

US 2004/0061578 A1 Apr. 1, 2004

(51) Int. Cl.[7] ..... H01P 1/10
(52) U.S. Cl. ..... 333/262; 333/103
(58) Field of Search ..... 333/101, 103, 333/262; 327/351, 374, 389, 427

(56) References Cited

U.S. PATENT DOCUMENTS

| | | | | |
|---|---|---|---|---|
| 4,417,157 A | | 11/1983 | Gershberg et al. | |
| 4,673,831 A | | 6/1987 | Reppen | |
| 4,978,932 A | * | 12/1990 | Gupta et al. | 333/81 R |
| 5,012,123 A | | 4/1991 | Ayasli et al. | |
| 5,027,007 A | * | 6/1991 | LaRue et al. | 326/117 |
| 5,107,152 A | | 4/1992 | Jain et al. | |
| 5,350,957 A | * | 9/1994 | Cooper et al. | 327/427 |
| 5,361,409 A | | 11/1994 | Vice | |
| 5,513,390 A | | 4/1996 | Vice | |
| 5,678,226 A | | 10/1997 | Li et al. | |
| 5,697,092 A | | 12/1997 | Mourant et al. | |
| 5,752,181 A | | 5/1998 | Vice | |
| 5,786,722 A | | 7/1998 | Buhler et al. | |
| 5,789,995 A | | 8/1998 | Minasi | |
| 5,799,248 A | | 8/1998 | Vice | |
| 5,818,283 A | | 10/1998 | Tonami et al. | |
| 5,825,227 A | * | 10/1998 | Kohama et al. | 327/308 |
| 5,945,867 A | | 8/1999 | Uda et al. | |
| 5,990,580 A | * | 11/1999 | Weigand | 307/125 |
| 6,064,872 A | | 5/2000 | Vice | |
| 6,094,088 A | | 7/2000 | Yano | |
| 6,310,508 B1 | * | 10/2001 | Westerman | 327/374 |
| 6,492,866 B1 | * | 12/2002 | Berg et al. | 327/581 |

OTHER PUBLICATIONS

*U.S. PatentApplication Publication* US2001/040479 A1.

* cited by examiner

*Primary Examiner*—Robert Pascal
*Assistant Examiner*—Dean Takaoka

(57) ABSTRACT

A switching system includes a first transistor having a first gate and coupled between a first terminal and a second terminal and a second transistor having a second gate and coupled between the second terminal and a third terminal. The first transistor and the second transistor are configured to conduct a signal current between the first terminal and the third terminal. An impedance component coupled to the first gate and the second gate is configured to isolate a first gate signal voltage at the first gate or isolate a second gate signal voltage at the second gate to reduce a distortion of the signal current.

17 Claims, 6 Drawing Sheets

SWITCHING SYSTEM

THE FIELD OF THE INVENTION

The present invention relates to a switching system, and more particularly, to a radio frequency switching device formed with field effect transistors.

BACKGROUND OF THE INVENTION

Switching operations for radio frequency applications can be accomplished by switching devices having a variety of configurations. One of the most common types of switching devices is the single pole single throw (SPST) switch. The SPST switching devices can be combined to perform complex switching operations, and should be able to switch large amounts of power.

One type of switching device commonly used for switching applications is illustrated generally at 6 in FIG. 1. The switching device 6 includes a PIN diode 8 and DC blocking capacitors 10 and 12. Switching device 6 includes inductors 14 and 16 to provide reactive isolation. Inductor 14 is coupled between a bias input 20 and an input 18 of PIN diode 8. Inductor 16 is coupled between a bias input 24 and an output 20 of PIN diode 8. The bias inputs 20 and 24 cause PIN diode 8 to switch from a non-conductive to a conductive state when the voltage difference between bias inputs 20 and 24 is sufficient to forward bias PIN diode 8. When PIN diode 8 is in the conductive state, switch circuit 6 passes an input signal received at an input 26 to output 28.

A disadvantage of this approach is the necessity of providing a constant DC current to forward bias PIN diode 8. The constant current requirements of PIN diode switches can be 10 milliamps or more. This high current requirement can be a particular disadvantage for portable devices which have limited power source availability.

Another type of switching device commonly used for switching applications is illustrated generally at 30 in FIG. 2. Switching device 30 includes a field effect transistor (FET) 32, DC blocking capacitors 34 and 36, and resistors 38 and 40. Bias inputs to FET 32 are provided at bias inputs 42 and 44. Bias inputs 42 and 44 cause FET 32 to switch from a non-conductive to a conductive state when the voltage difference between bias inputs 42 and 44 exceeds the gate to source threshold voltage for FET 32. Switch circuit 30 passes a signal from an input 50 to an output 52 when FET 32 is biased in the conductive state.

A disadvantage of this approach is that the linearity of FET 32 is poor when FET 32 is in either the non-conductive or the conductive state. The poor linearity results from the sensitivity of FET 32 to changes in the drain-to-source voltage observed between lines 46 and 48. When bias input 44 is set to a defined voltage level and FET 32 is in the conductive state, changes in the input signal at 50 can modulate the channel resistance of FET 32 resulting in signal distortion and poor linearity. Distortion can also occur if FET 32 is biased in the non-conductive state and the input signal at 50 causes a drain-to-source voltage which is large enough to put FET 32 back into the conductive state.

In view of the above, there is a need for an improved switch which minimizes signal distortion while requiring minimal current to operate.

SUMMARY OF THE INVENTION

One aspect of the present invention provides a switching system which includes a first transistor having a first gate and coupled between a first terminal and a second terminal and a second transistor having a second gate and coupled between the second terminal and a third terminal. The first transistor and the second transistor are configured to conduct a signal current between the first terminal and the third terminal. An impedance component coupled to the first gate and the second gate is configured to isolate a first gate signal voltage at the first gate or isolate a second gate signal voltage at the second gate to reduce a distortion of the signal current.

DETAILED DESCRIPTION

In the following detailed description, references are made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
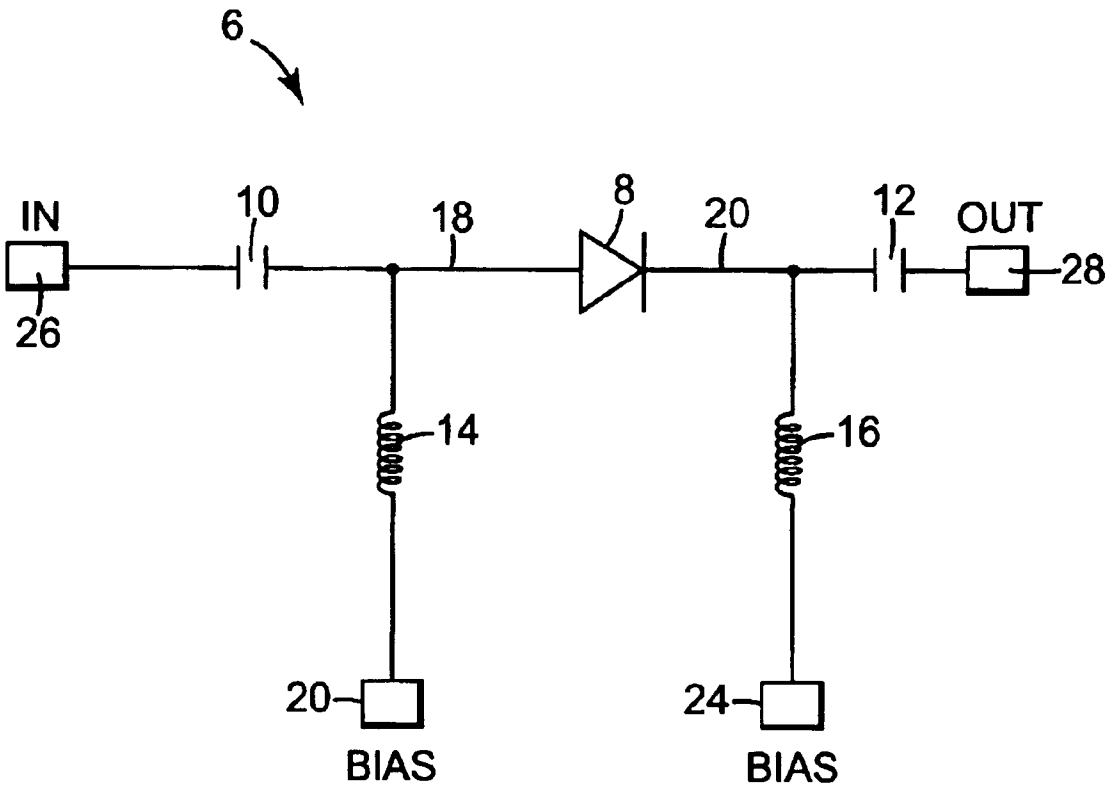
Fig. 1 (PRIOR ART)
FIG. 1 illustrates a conventional switching device which uses a PIN diode.
Figure 2:
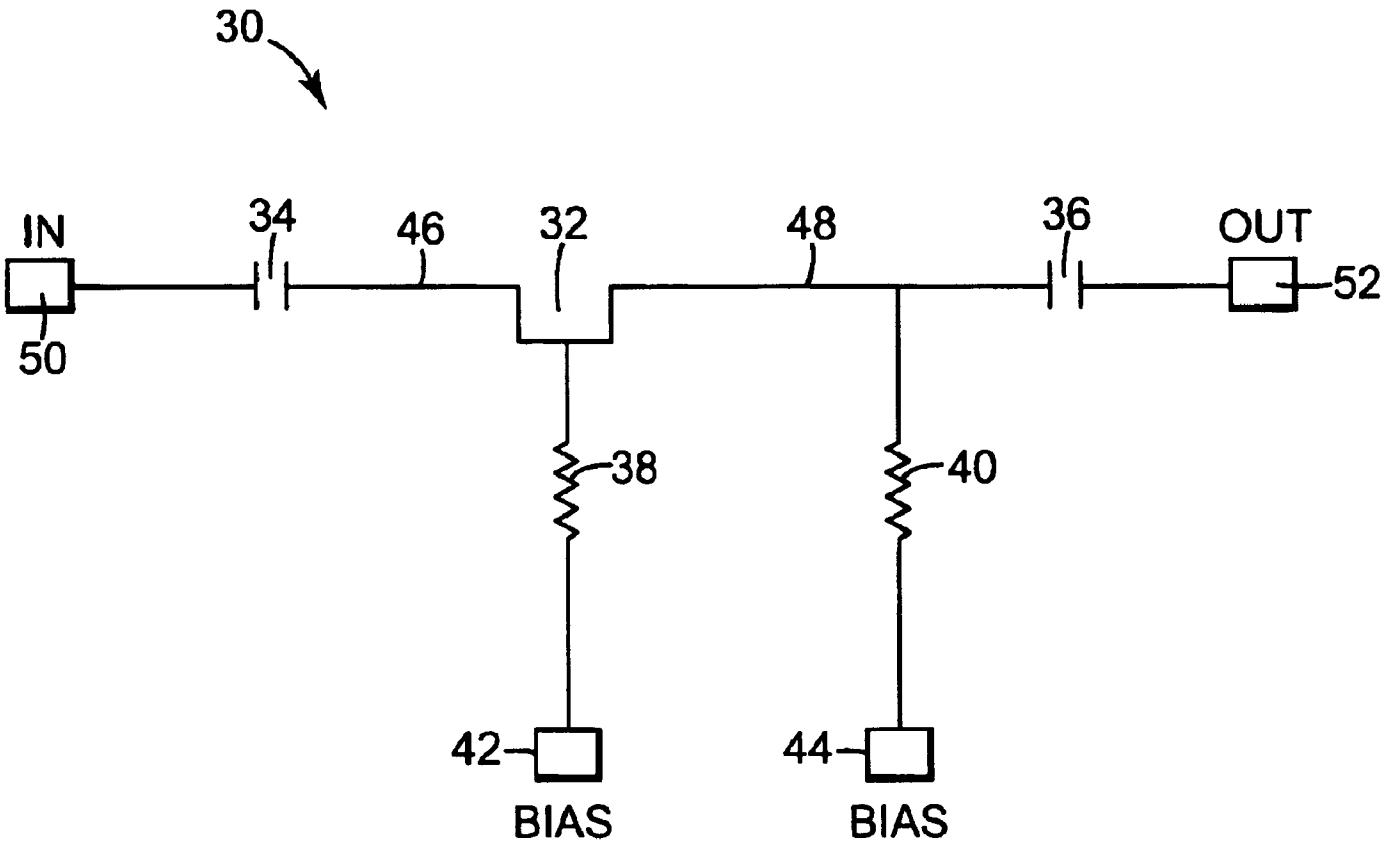
Fig. 2 (PRIOR ART)
FIG. 2 illustrates a conventional switching device which uses a field effect transistor.
Figure 3:
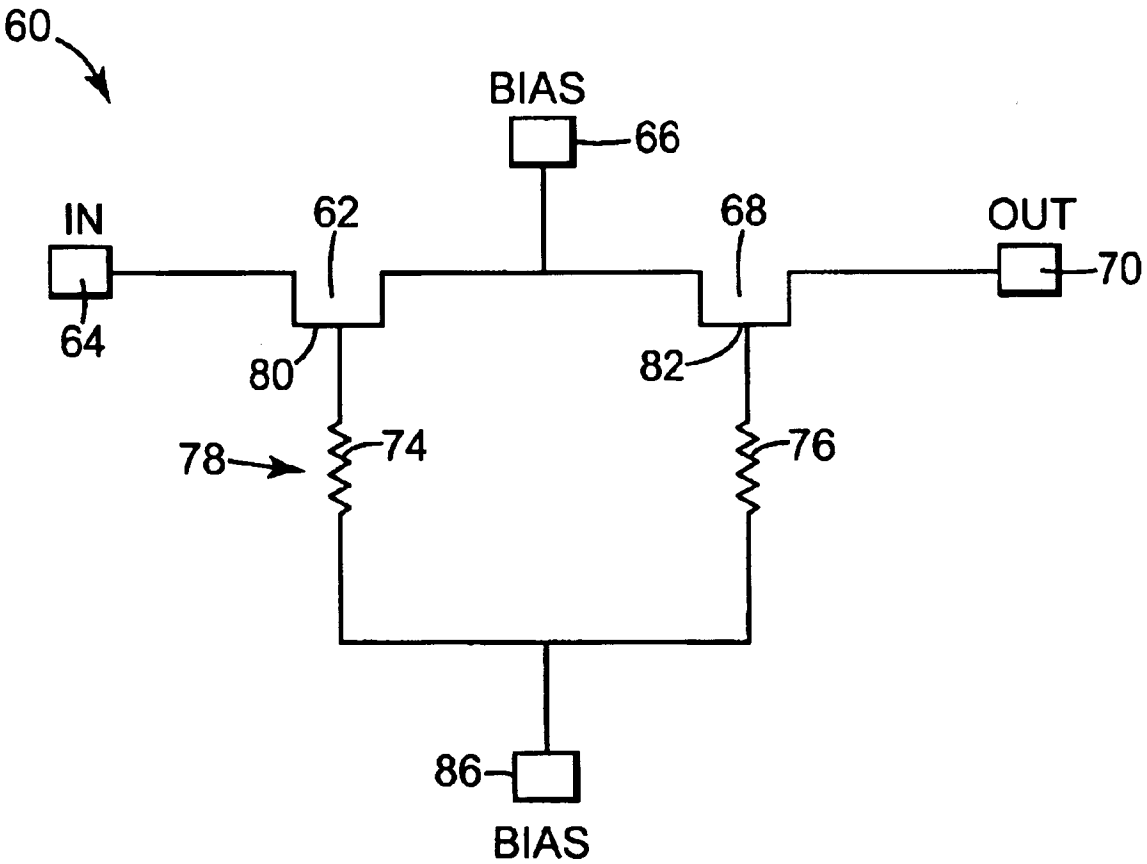
FIG. 3 is a schematic diagram illustrating a first exemplary embodiment of a switching device according to the present invention.

FIG. 3 is a schematic diagram illustrating a first exemplary embodiment of a switching device 60 according to the present invention. Switching device 60 include a transistor 62 coupled between an input terminal or port 64 and a bias terminal or port 66. A transistor 68 is coupled between bias terminal 66 and an output terminal or port 70. Transistors 62 and 68 are configured to conduct a signal current between input terminal 64 and output terminal 70.

In the illustrated embodiment, a resistor 74 and a resistor 76 together comprise an impedance component 78. Impedance component 78 is operative to isolate a first gate signal voltage at a gate 80 and isolate a second gate signal voltage at a gate 82 to reduce the distortion of a signal conducted between input terminal 64 and output terminal 70.

In the illustrated embodiment, resistor 74 is coupled between gate 80 of transistor 62 and a bias terminal or port 86. Bias terminal 86 is configured to apply a bias voltage to gate 80. Resistor 76 is coupled between gate 82 and bias terminal 86. Bias terminal 86 is configured to apply the bias voltage to gate 82. The bias voltage applied at bias terminal 86 is provided at a suitable voltage level relative to bias terminal 66 to cause transistor 62 and transistor 68 to switch to either a non-conductive state or a conductive state.

In one embodiment, transistor 62 and transistor 68 are field effect transistor (FETs). In one embodiment, FET 62 and FET 68 are metal-oxide semiconductor (MOS) transistors. In another embodiment, FET 62 and FET 68 are gallium arsenide metal-semiconductor field effect transistors (GaAs MESFETs). In another embodiment, FET 62 and FET 68 are enhancement-mode pseudomorphic high-electron mobility (E-pHEMT) transistors. In various other embodiments, transistor 62 and transistor 68 are other suitable types of transistors.

In the illustrated embodiment, resistor 74 has an impedance which is greater than an impedance between gate 80 and input terminal 64, or between gate 80 and bias terminal 66. In one embodiment, a ratio of the impedance of resistor 74 to an impedance between gate 80 and input terminal 64, or between gate 80 and bias terminal 66, is greater than one such that a first gate signal voltage has a value which is tending toward the midpoint of the value of a voltage at input terminal 64 and the value of a voltage at bias terminal 66.

In the illustrated embodiment, resistor 76 has an impedance which is greater than an impedance between gate 82 and output terminal 70, or between gate 82 and bias terminal 66. In one embodiment, a ratio of the impedance of resistor 76 to an impedance between gate 82 and output terminal 70, or between gate 82 and bias terminal 66, is greater than one such that a second gate signal voltage has a value which is tending toward the midpoint of the value of a voltage at output terminal 70 and the value of a voltage at bias terminal 66.

In one embodiment, the signal input at input terminal 64 is a radio frequency signal and the signal current conducted between input terminal 64 and output terminal 70 is a radio frequency signal current. In one embodiment, the first gate signal voltage and the second gate signal voltage are radio frequency signal voltages.

In the illustrated embodiment, resistor 74 couples the bias voltage applied at bias terminal 86 to gate 80 and isolates the first gate signal voltage at gate 80. The isolation occurs when the impedance between gate 80 and the drain/source of transistor 62 which is coupled to input terminal 64, or between gate 80 and the source/drain of transistor 62 which is coupled to bias terminal 66, is at least greater than one such that the first gate signal voltage coupled to gate 80 cannot be appreciably altered by conduction through resistor 74. The impedance between gate 80 and either the drain or the source of transistor 62 results from parasitic capacitances which are present between gate 80 and the drain/source or source/drain regions. The parasitic capacitance provides a displacement current path for parasitic currents which allows the voltage at gate 80 to float to a value which is between the voltage at input terminal 64 and the voltage at bias terminal 66. In one embodiment, the ratio between the impedance of resistor 74 and the impedance between gate 80 and input terminal 64 or bias terminal 66 is a suitable value greater than one which enables the first gate signal voltage to have a value which is approximately midway between the input terminal voltage at input terminal 64 and the bias terminal voltage at bias terminal 66.

In the illustrated embodiment, resistor 76 couples the bias voltage applied at bias terminal 86 to gate 82 and isolates the second gate signal voltage at gate 82. The isolation occurs when the impedance between gate 82 and the drain/source of transistor 68 which is coupled to output terminal 70, or between gate 82 and the source/drain of transistor 68 which is coupled to bias terminal 66, is at least greater than one such that the second gate signal voltage coupled to gate 82 cannot be appreciably altered by conduction through resistor 76. The impedance between gate 82 and either the drain/source or the source/drain of transistor 68 results from parasitic capacitances which are present between gate 82 and the drain/source or source/drain regions. The parasitic capacitance provides a conduction path for parasitic currents which allows the voltage at gate 82 to charge or float to a value which is between the voltage at output terminal 70 and the voltage at bias terminal 66. In one embodiment, the ratio between the impedance of resistor 76 and the impedance between gate 82 and output terminal 70 or bias terminal 66 is a suitable value greater than one, which enables the second gate signal voltage to have a value which is approximately midway between the output terminal voltage at output terminal 70 and the bias terminal voltage at bias terminal 66.

In the illustrated embodiment, transistor 62 and transistor 68 have substantially matched electrical characteristics, and resistor 74 and resistor 76 have substantially the same values. In the illustrated embodiment, a difference between the input terminal voltage at input terminal 64 and the bias terminal voltage at bias terminal 66 is substantially the same and opposite in polarity to a difference between the output terminal voltage at output terminal 70 and the bias terminal voltage at bias terminal 66. Since transistor 62 and transistor 68 have substantially matched electrical characteristics, and resistor 74 and resistor 76 have substantially matched resistance values, the electrical operation of resistor 76 and transistor 68 is substantially the same as the electrical operation of resistor 74 and transistor 62 described earlier. In other embodiments, transistor 62 and transistor 68 have other suitable electrical characteristics, and resistor 74 and resistor 76 have other suitable resistance values.

In the illustrated embodiment, when a voltage difference between bias terminal 86 and the bias terminal 66 is not sufficient to switch transistor 62 or transistor 68 to a conductive state, an improvement in linearity results, because transistor 62 and transistor 68 cannot be simultaneously switched to the conductive state when the input signal at input terminal 64 has either a positive or a negative value with respect to the bias voltage at bias terminal 66. In the illustrated embodiment, when the first gate signal voltage has a value approximate midway between the input terminal voltage at input terminal 64 and the bias terminal voltage at bias terminal 66, a difference between the first gate signal voltage at gate 80 and either the input terminal voltage at input terminal 64 or the bias terminal voltage at bias terminal 66 is maximized, thereby maximizing the magnitude of the signal input voltage at input terminal 64 which is sufficient to switch transistor 62 to a conductive state. In the illustrated embodiment, when the second gate signal voltage has a value approximately midway between the output terminal voltage at output terminal 70 and the bias terminal voltage at bias terminal 66, a difference between the second gate signal voltage at gate 82 and either the output terminal voltage at output terminal 70 or the bias terminal voltage at bias terminal 66 is maximized, thereby maximizing the magnitude of the signal output voltage at output terminal 70 which is sufficient to switch transistor 68 to a conductive state.

Figure 4A:
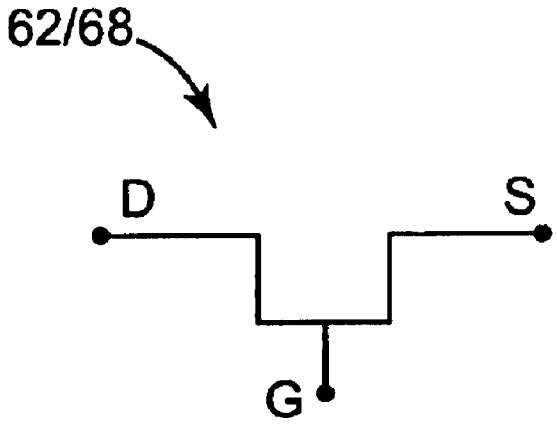
FIGS. 4A and 4B are representational diagrams of transistors employed in the switching device illustrated in FIG. 3.
Figure 4B:
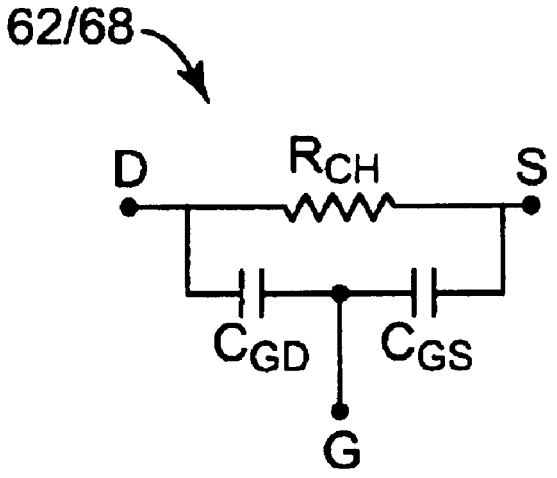

FIGS. 4A and 4B are representational diagrams of transistor 62 or transistor 68 for illustrating the operating characteristics of transistors 62 and 68. In FIG. 4A, a transistor 62/68 is represented to have a gate G, a drain D and a source S. FIG. 4B illustrates equivalent impedance components of transistor 62/68. A channel resistance $R_{CH}$ is illustrated as a resistor coupled between the drain D and the source S. A parasitic capacitance $C_{GD}$ is illustrated as a capacitor coupled between the gate G and the drain D. A parasitic capacitance $C_{GS}$ is illustrated as a capacitor coupled between the gate G and the source S. As illustrated in FIG. 4B, when transistor 62/68 is in the conductive state, a portion of a signal conducted between the drain D and the source S is coupled to the gate G through capacitors $C_{GD}$ and $C_{GS}$. When transistor 62/68 is in a non-conductive state, a portion of the signal at the drain D is coupled to the gate G through capacitor $C_{GD}$.

Referring to FIG. 3, when resistor 74 has a sufficiently large resistance value, a discharge time constant of resistor 74 and capacitor $C_{GD}$ or capacitor $C_{GS}$ of transistor 62 is sufficiently large relative to a time period of the signal coupled through capacitor $C_{GD}$ or capacitor $C_{GS}$ to the gate G that the first gate signal voltage is not significantly discharged through resistor 74 within the time period. When resistor 76 has a sufficiently large resistance value, a discharge time constant of resistor 76 and capacitor $C_{GD}$ or capacitor $C_{GS}$ of transistor 68 is sufficiently large relative to the time period of the signal coupled through capacitor $C_{GD}$ or capacitor $C_{GS}$ to the gate G that the second gate signal voltage is not significantly discharged through resistor 76 within the time period.

Figure 5:
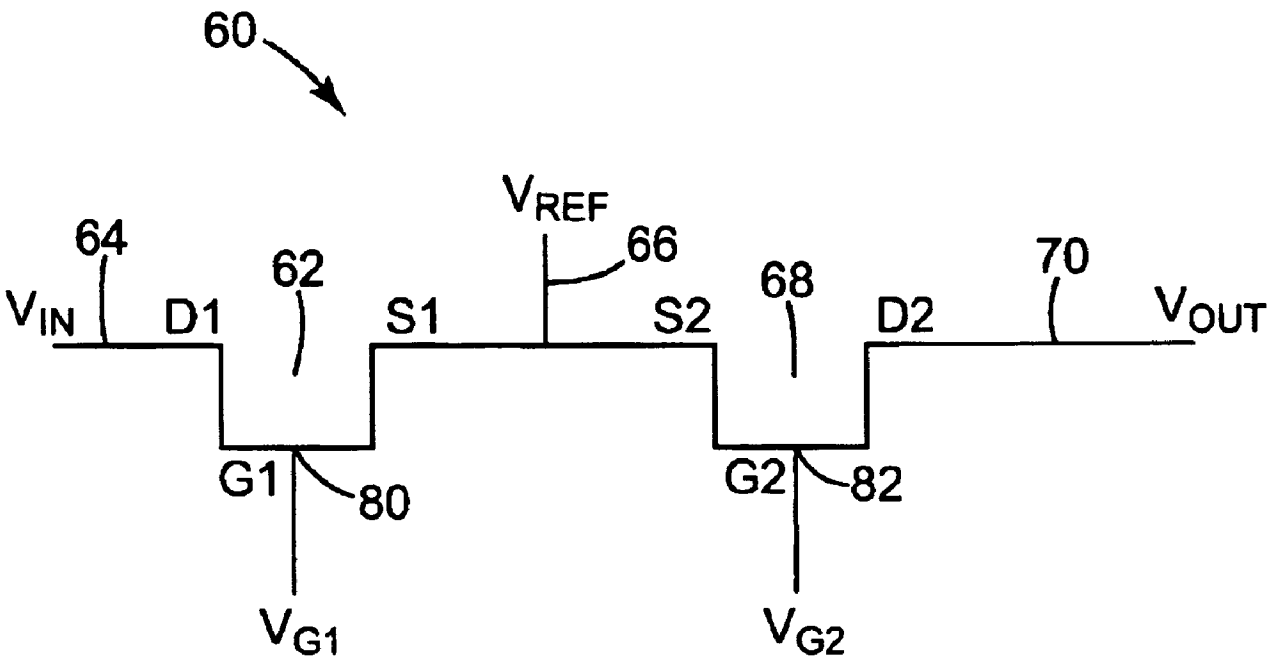
FIG. 5 is a representational schematic diagram of a portion of the switch of FIG. 3 illustrating a signal which is passed from the switch input to the switch output.

FIG. 5 is a representational schematic diagram of a portion of the switch 60 of FIG. 3 illustrating a signal which is passed from the switch input terminal 64 to the switch output terminal 70. Transistor 62 is represented as having a drain D1, a gate G1, and a source S1. The drain D1 is coupled to a signal input $V_{IN}$ at input terminal 64. The source S1 is coupled to $V_{REF}$ at bias terminal 66. Transistor 68 has a drain D2, a gate G2, and a source S2. The drain D2 is coupled to a signal output $V_{OUT}$ at output terminal 70. The source S2 is coupled to $V_{REF}$ at bias terminal 66. The gate G1 of transistor 62 is coupled to a voltage input $V_{G1}$. The gate G2 of transistor 68 is coupled to a voltage input $V_{G2}$.

In the illustrated embodiment, when transistor 62 and transistor 68 are in a conductive state, the distortion of a signal conducted between the $V_{IN}$ input at input terminal 64 and the $V_{OUT}$ output at output terminal 70 is reduced by compensating changes in channel resistance in transistor 62 and transistor 68. To illustrate the effect of compensating changes in the channel resistance, certain parameters of transistor 62 and transistor 68 can be represented by equations as follows for the circuit illustrated in FIG. 5. The signal applied at the $V_{IN}$ input is assumed to not have a DC component so equations for the circuit illustrated at 60 can be represented as follows:

$$(V_{IN}-V_{OUT})_{DC}=0$$

$$V_{D1S1\text{-}DC}=0$$

$$V_{D2S2\text{-}DC}=0$$

To a first approximation, the circuit illustrated at 60 is symmetrical with respect to $V_{IN}$ and $V_{OUT}$, therefore:

$$V_{D1S1}=-V_{D2S2}$$

The terminal voltages of transistor 62 and transistor 68 can be summed as follows:

$$V_{D1G1}+V_{G1S1}=V_{D1S}$$

$$V_{D2G2}+V_{G2S2}=V_{D2S2}$$

The voltages at gate 80 of transistor 62 and gate 82 of transistor 68 have a DC voltage component so that transistor 62 and transistor 68 can be turned on into a conductive state. The equations for transistor 62 and transistor 68 can be written as follows:

$$V_{G1S1}=V_{G1S1\text{-}DC}+\alpha V_{D1S1}, \text{ where } \alpha \text{ is a constant}$$

$$V_{G1D1}=V_{G1D1\text{-}DC}+\beta V_{D1S1}, \text{ where } \beta \text{ is a constant}$$

$$V_{G2S2}=V_{G2S2\text{-}DC}+\alpha V_{D2S2}$$

$$V_{G2D2}=V_{G2D2\text{-}DC}+\beta V_{D2S2}$$

Because circuit 60 is symmetrical to a first approximation, the equations for the terminal voltages of transistor 60 and transistor 62 have the following equivalencies:

$$V_{G1S1\text{-}DC}=V_{G1D1\text{-}DC}=V_{G2S2\text{-}DC}=V_{G2D2\text{-}DC}=V_{DC}$$

$$V_{D1S1}=-V_{D2S2}$$

A substitution of $V_{DC}$ can be made as follows:

$$V_{G1S1}=V_{DC}+\alpha V_{D1S1}$$

$$V_{G1D1}=V_{DC}+\beta V_{D1S1}$$

$$V_{G2S2}=V_{DC}-\alpha V_{D1S1}$$

$$V_{G2D2}=V_{DC}-\beta V_{D1S1}$$

The total channel resistance of transistor 62 and transistor 68 can be represented as:

$$R_{TOTAL}=R_{D1S1}+R_{D2S2}$$

where $R_{D1S1}$ represents the drain to source resistance of transistor 62 and $R_{D2S2}$ represents the drain to source resistance of transistor 68. Equations can be written for $R_{D1S1}$ and $R_{D2S2}$ as follows:

$$R_{D1S1}=AV_{G1S1}+BV_{G1D1}, \text{ where A and B are constants}$$

$$R_{D2S2}=AV_{G2S2}+BV_{G2D2}$$

With substitution of the above equations, the total resistance can be represented as follows:

$$\begin{aligned} R_{TOTAL} &= A(V_{DC}+\alpha V_{D1S1})+B(V_{DC}+\beta V_{D1S1})+ \\ &\quad A(V_{DC}-\alpha V_{D1S1})+B(V_{DC}-\beta V_{D1S1}) \\ &= (A+B)V_{DC} \end{aligned}$$

The equation $R_{TOTAL}=(A+B)V_{DC}$ illustrates the compensating effect from the presence of the AC signal component at gate 80 of transistor 62 and gate 82 of transistor 68.

In the illustrated embodiment, when transistor 62 and transistor 68 are in a non-conductive state, the linearity is improved between the $V_{IN}$ input at input terminal 64 and the $V_{OUT}$ output at output terminal 70 because transistor 62 and transistor 68 cannot be simultaneously switched to the conductive state by a signal input at the $V_{IN}$ input at input terminal 64. In one example embodiment, $V_{IN}$ is less than zero and transistors 62 and 68 are configured so that the $V_{IN}$ and $V_{OUT}$ terminals are both drains. In this example embodiment, $V_{G1D1}$ becomes less negative and transistor 62 tends to turn on into a conductive state, while $V_{G2D2}$ becomes more negative and transistor 68 tends to turn further off in the non-conductive state. In the illustrated embodiment, with sufficient values for resistor 74 and resistor 76, $V_{G1}$ charges to a value between $V_{D1}$ and $V_{S1}$ and $V_{G2}$ charges to a value between $V_{S2}$ and $V_{D2}$, thereby increasing the input signal voltage which is sufficient to switch transistor 62 or second transistor 68 back to the conductive state.

In one embodiment, $V_{G1}$ has a value which is at a midpoint between $V_{D1}$ and $V_{S1}$, and $V_{G2}$ has a value which is at a midpoint between $V_{D2}$ and $V_{S2}$. In this embodiment, a maximum input signal voltage at input terminal 64 is required to switch transistor 62 or second transistor 68 to the conductive state, thereby improving the linearity of transistor 62 and transistor 68 in the non-conductive state.

Figure 6:
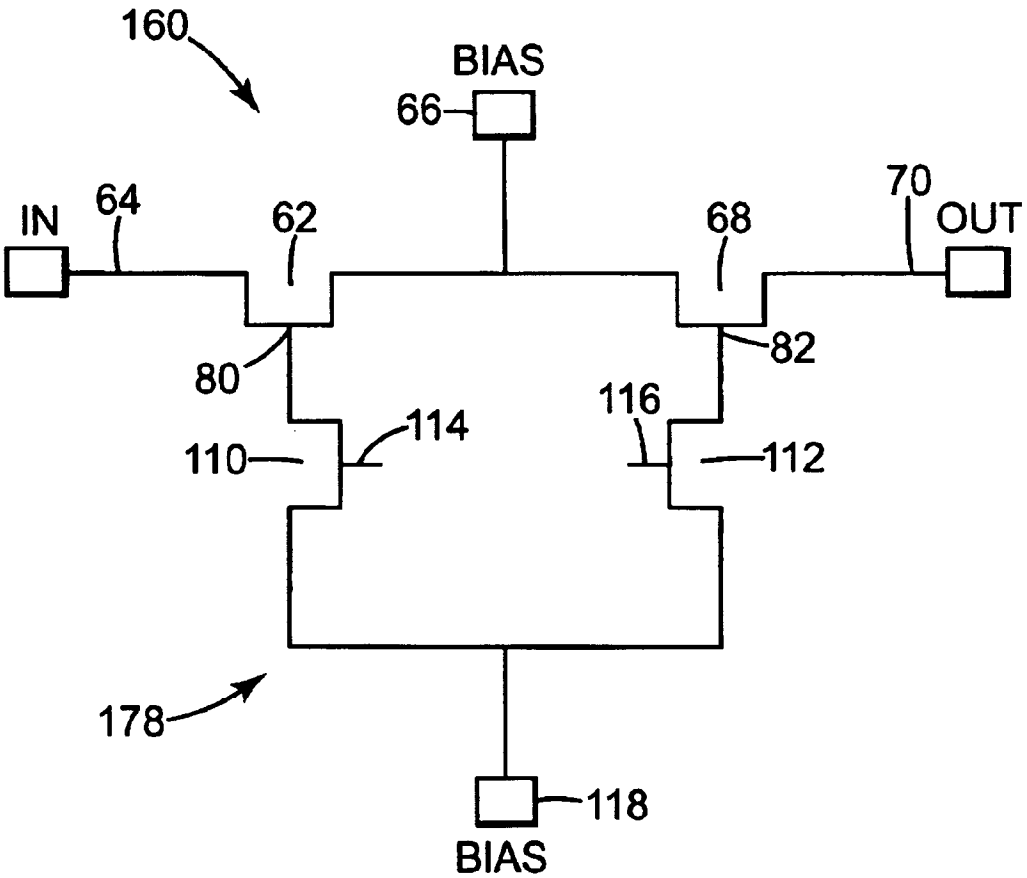
FIG. 6 is a schematic diagram illustrating a second exemplary embodiment of a switching device according to the present invention.

FIG. 6 is a schematic diagram illustrating a second exemplary embodiment of a switching device 160 according to the present invention. The second exemplary embodiment of switching device 160 is similar to the first exemplary embodiment of switching device 60 illustrated in FIG. 3 except that resistor 74 is replaced by a transistor 110 and resistor 76 is replaced by a transistor 112. In the second exemplary embodiment, transistor 110 and transistor 112 together comprise an impedance component 178. Impedance component 178 is operative to isolate the first gate signal voltage at gate 80 or isolate the second gate signal voltage at gate 82 to reduce the distortion of a signal conducted between input terminal 64 and output terminal 70. In the second exemplary embodiment, transistor 110 has a voltage bias supplied at a gate 114 and transistor 112 has a voltage bias supplied at a gate 116. In the second exemplary embodiment, the bias at gate 114 and gate 116 is sufficient to bias transistor 110 and transistor 112 into a conductive state.

In the second exemplary embodiment, the voltage bias level at gate 114 and the physical or electrical size of transistor 110 are suitably defined to provide an impedance between gate 80 and a bias terminal 118 which is greater than an impedance between gate 80 and input terminal 64, or between gate 80 and bias terminal 66. The voltage bias level at gate 116 and the physical or electrical size of transistor 112 are suitably defined to provide an impedance between gate 82 and bias terminal 118 which is greater than an impedance between gate 82 and output terminal 70, or between gate 82 and bias terminal 66.

In other embodiments, other suitable approaches can be used to provide an impedance to isolate or float the first gate signal voltage at gate 80 or to isolate or float the second gate signal voltage at gate 82. These other approaches include other transistor types which can be configured to provide suitable impedance values. These other embodiments include resistors, capacitors, inductors, or transistors, or suitable combinations of resistors, capacitors, inductors or transistors.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A switching system, comprising:

first and second field effect transistors having substantially matched electrical characteristics, wherein each field effect transistor has a gate, a drain and a source; and third and fourth field effect transistors coupled to the gates of the first and second field effect transistors and having substantially matched electrical characteristics, wherein the third and fourth field effect transistors are configured to apply a bias voltage to the gates of the first and second field effect transistors sufficient to switch the transistors from a non-conductive state to a conductive state, and configured to control a signal current conducted through the first and second field effect transistors by enabling the gate of the first field effect transistor to float to a voltage that is between a drain voltage and a source voltage of the first field effect transistor and by enabling the gate of the second field effect transistor to float to a voltage that is between a drain voltage and a source voltage of the second field effect transistor.

2. A switching system comprising:

a first transistor having a first gate and coupled between a first terminal and a second terminal;

a second transistor having a second gate and coupled between the second terminal and a third terminal, wherein the first transistor and the second transistor are configured to conduct a signal current between the first terminal and the third terminal;

a first impedance component coupled between the first gate and a fourth terminal, wherein the first impedance component is configured to apply a bias voltage to the first gate; and a second impedance component coupled between the second gate and the fourth terminal, wherein the second impedance component is configured to apply the bias voltage to the second gate, wherein the bias voltage is sufficient, relative to the second terminal, to switch the first transistor and the second transistor from a non-conductive state to a conductive state, and wherein a ratio of an impedance of the first impedance component to an impedance between the first gate and the first terminal or the second terminal is sufficient to enable the first gate signal voltage to have a value which is approximately midway between a first terminal voltage and a second terminal voltage.

3. The switching system of claim 2, wherein the ratio is greater than one.

4. The switching system of claim 2, wherein the first transistor and the second transistor have symmetrical non-linear resistance to reduce the distortion of the signal current.

5. The switching system of claim 1, wherein the first transistor and the second transistor have substantially matched electrical characteristics and the first impedance component and the second impedance component have substantially a same value so that a difference between the first terminal voltage and the second terminal voltage is substantially the same and opposite in polarity to a difference between a third terminal voltage and the second terminal voltage.

6. The switching system of claim 2, wherein the first gate signal voltage and the second gate signal voltage are not equal.

7. The switching system of claim 2, wherein the first transistor and the second transistor are field effect transistors.

8. The switching system of claim 7, wherein the first field effect transistor and the second field effect transistor are metal-oxide semiconductor transistors.

9. The switching system of claim 7, wherein the first field effect transistor and the second field effect transistor are gallium arsenide metal-semiconductor field effect transistors.

10. The switching system of claim 7, wherein the first field effect transistor and the second field effect transistor are enhancement-mode pseudomorphic high-electron mobility transistors.

11. The switching system of claim 2, wherein the signal current is a radio frequency signal current and the first gate signal voltage is a radio frequency signal voltage.

12. The switching system of claim 2, wherein the first impedance component comprises a third transistor and the second impedance component comprises a fourth transistor.

13. The switching system of claim 12, wherein the third transistor and the fourth transistor have substantially matched electrical characteristics.

14. The switching system of claim 2, wherein the first impedance component comprises a first resistor and the second impedance component comprises a second resistor.

15. The switching system of claim 14, wherein a resistance value of the first resistor is substantially equal to a resistance value of the second resistor.

16. A method of controlling a signal current in a switching device, comprising:

providing a first transistor having a first gate and coupled between a first terminal and a second terminal;

providing a second transistor having a second gate and coupled between the second terminal and a third terminal;

conducting a signal current between the first terminal and the third terminal;

isolating a first gate signal voltage at the first gate or a second gate signal voltage at the second gate to reduce a distortion of the signal current; and applying an impedance between a fourth terminal and the first gate which is sufficient to enable the first gate signal voltage to have a value which is approximately midway between a first terminal voltage and a second terminal voltage.

17. The method of claim 16, comprising applying an impedance between a fourth terminal and the second gate which is sufficient to enable the second gate signal voltage to have a value which is approximately midway between a second terminal voltage and a third terminal voltage.

* * * * *